US007845104B1

(12) United States Patent
Holzapfel

(10) Patent No.: US 7,845,104 B1
(45) Date of Patent: Dec. 7, 2010

(54) DEVICE AND METHOD FOR DISPLAYING ADVERTISING ON A TURNSTILE ARM

(75) Inventor: Joseph Holzapfel, Ralston, NE (US)

(73) Assignee: Entry Media, Inc., Winter Park, FL (US)

( * ) Notice: Subject to any disclaimer, the term of this patent is extended or adjusted under 35 U.S.C. 154(b) by 321 days.

(21) Appl. No.: 12/141,956

(22) Filed: Jun. 19, 2008

Related U.S. Application Data

(60) Provisional application No. 60/945,417, filed on Jun. 21, 2007.

(51) Int. Cl.
*E06B 11/08* (2006.01)

(52) U.S. Cl. ..... 40/660; 49/47; 49/46; 40/661.12; 40/661

(58) Field of Classification Search ..... 40/493, 40/484, 430, 661.12, 606.14; 280/33.992; 49/46, 42; 138/159, 99
See application file for complete search history.

(56) References Cited

U.S. PATENT DOCUMENTS

| | | | | |
|---|---|---|---|---|
| 2,156,553 | A | 5/1939 | Vendope | |
| 3,270,454 | A * | 9/1966 | Lachance | 40/308 |
| 3,281,978 | A * | 11/1966 | Drugan et al. | 40/308 |
| 4,021,953 | A | 5/1977 | Couch | |
| 4,164,084 | A | 8/1979 | Crockett | |
| 4,329,801 | A * | 5/1982 | Clausen | 40/607.03 |
| 5,085,535 | A | 2/1992 | Solberg et al. | |
| 5,116,204 | A | 5/1992 | Power et al. | |
| 5,301,443 | A | 4/1994 | Gori | |
| 5,570,541 | A | 11/1996 | Hering | |
| 5,810,372 | A * | 9/1998 | Arendt | 280/33.992 |
| 6,009,653 | A | 1/2000 | Harrington | |
| 6,212,809 | B1 | 4/2001 | Gaule | |
| 6,345,458 | B1 | 2/2002 | Garibian | |
| 6,499,423 | B2 | 12/2002 | Mills | |
| 6,718,675 | B1 | 4/2004 | Lu | |
| 6,986,220 | B2 | 1/2006 | Kaulbach | |
| 7,096,625 | B1 | 8/2006 | Hering | |
| 2004/0148831 | A1 | 8/2004 | Johnston | |

* cited by examiner

*Primary Examiner*—Cassandra Davis
(74) *Attorney, Agent, or Firm*—Allen, Dyer, Doppelt, Milbrath & Gilchrist, P.A.

(57) ABSTRACT

A device for displaying advertising from a turnstile arm includes opposing collars securing a sleeve displaying the advertising. One collar is frictionally secured to the arm using an O-ring carried in a groove within an inside wall surface of an opening through which the arm passes. A flange extending fully around the outside surface of the collar provides a snap-fit into a groove within one end of the sleeve. The outside surfaces of the collars make a smooth transition to the connected sleeve. A second collar includes a clamp is carried within its opening securing the second collar to the turnstile arm. Two recessed portions have a bore extending through the second collar through which fasteners extend for adjusting the clamping. A notch extending around the second collar receives the sleeve.

20 Claims, 5 Drawing Sheets

DEVICE AND METHOD FOR DISPLAYING ADVERTISING ON A TURNSTILE ARM

CROSS-REFERENCE TO RELATED APPLICATIONS

This application claims the benefit of U.S. Provisional Application No. 60/945,417, filed Jun. 21, 2007, the disclosure of which is hereby incorporated by reference herein in its entirety all commonly owned.

FIELD OF INVENTION

The present invention relates to devices for advertising or displaying marketing material and in more particularly to devices for displaying advertising from a turnstile arm and the like.

BACKGROUND OF THE INVENTION

Advertising devices for turnstiles are generally known as described by way of example with reference to U.S. Pat. No. 5,430,974 to. Herring for "An Indicia Device for Turnstile and Method of Use." Generally, such devices for holding or displaying indicia include a transparent tube for carrying indicia on a sheet carried within the tube as also disclosed in U.S. Pat. No. 6,212,809 to Gaule for an apparatus for supporting indicia with a rail Collars or clamps are typically used to secure the tube to the arm. With the ever growing interest in such advertising form, there is a need for securing advertising indicia to the turnstile arm in a safe, inexpensive, and efficient manner. Typically, opposing collars securing the tube are both rigidly attached to the turnstile arm making it difficult to change the advertising sheet. The tube is generally threaded or permanently glued to the opposing collars. The collars, while rigid, include shapes that undesirably irritate a person contacting the device while passing through a passageway for which the arm controls access.

SUMMARY OF THE INVENTION

The present invention may be embodied in a turnstile arm advertising device that includes a transparent tube for carrying advertising on a sheet positioned within the tube. The transparent tube may be secured between distal and proximal ends of the turnstile arm using opposing collars. One locking collar may be used to secure the tube to the turnstile arm while a second, non-locking collar may be used to align the tube with the arm. The non-locking collar may be frictionally attached to the transparent tube. The locking collar may be secured to the turnstile arm using friction devices such as a clamp and clamping screw for securing the tube to the arm.

One embodiment may include an advertising device comprising first and second opposing collars each having an opening therethrough dimensioned for closely receiving an arm, a tubular sleeve having opposing first and second ends and a transparent portion therebetween, the first and second ends connected to the opposing first and second collars, respectively, and indicia displayed from the tubular sleeve, wherein at least one of the first and second opposing collars comprises a generally cylindrical body wherein the opening is defined by an inside wall surface, a groove within the inside wall surface, the groove extending fully around the cylindrical body, a flexible seal carried within the groove, wherein the turnstile arm is received within the flexible seal for frictionally securing the first collar to the arm, the generally cylindrical body further defined by an outside surface, wherein the outside surface comprises a flange extending fully around the outside surface, and wherein the flange closely receives the first end of the sleeve therein, and wherein the sleeve includes a groove therein for frictionally securing the sleeve first end in a snap-fit connection to the cylindrical body, and wherein an outside diameter of the cylindrical body is similar to an outside diameter of the sleeve, thus providing a smooth transition along an outside surface of the device from the sleeve outside surface to the first collar outside surface.

A second embodiment may be described as an advertising device comprising first and second opposing collars each having an opening therethrough dimensioned for closely receiving an arm, a tubular sleeve having opposing first and second ends and a transparent portion therebetween, the first and second ends connected to the opposing first and second collars, respectively, indicia displayed from the tubular sleeve, wherein at least one of the opposing first and second collars comprises a generally cylindrical body having the opening extending therethrough being a generally central opening defined by at least two inside surface portions dimensioned for making frictional contact with the turnstile arm, a clamp carried within the central opening, the clamp having a cradle portion opposing the at least two inside surface portions for making frictional contact with the turnstile arm, the generally cylindrical body further defined by an outside surface, wherein the outside surface comprises two recessed portions each having a bore extending through the generally cylindrical body, a fastener having a proximal end carried within each recessed portion and a distal end extending through each bore to opposing ends of the clamp, wherein an adjustment to each fastener releases and tightens a frictional connection of the second collar to the turnstile arm, and wherein the proximal end of each fastener is entirely within the recessed portion and within an outside diameter of the cylindrical body, the inside surface further comprises a notch extending fully around the cylindrical body, wherein the notch closely receives the second end of the sleeve therein for securing the sleeve second end and thus the sleeve to the second collar, and wherein an outside diameter defining the cylindrical body is similar to an outside diameter of the sleeve, thus providing a smooth transition along an outside surface of the device from the sleeve outside surface to the second collar outside surface.

Optionally, the opening in the collar may comprise a central opening resulting from a longitudinal axis of the arm being generally aligned with a center of the cylindrical body or may comprise an off-center opening, wherein a longitudinal axis of the arm is offset from a center of the opening, thus providing an increased spacing between the arm surface and a side portion of the tubular sleeve.

DETAILED DESCRIPTION OF THE PREFERRED EMBODIMENTS

Figure 1:
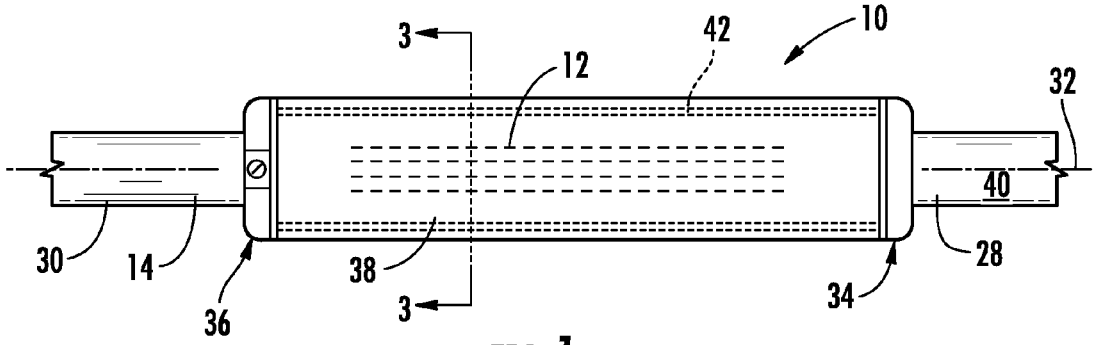
FIG. 1 is a front perspective view illustrating one embodiment of an advertising device useful for displaying advertising indicia from an arm of a turnstile.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

As illustrated with reference initially to FIG. 1, one embodiment of the present invention includes an advertising device 10 useful for displaying advertising indicia 12 from a turnstile arm 14, wherein one turnstile 16 having multiple arms 14 rotatable about a pivotal portion 18 of a turnstile housing 20 is illustrated by way of example with reference to FIG. 2. The turnstile arm 14 is movable within a passageway 22 between a first position 24 blocking the passageway 22, as seen for arm 14A and a second position 26 allowing a person to move therethrough, as illustrated by the arm 14B in FIG. 2. By way of the example herein illustrated, the turnstile arm 14 has its distal end 28 extending sufficiently into the passageway 22 for blocking a person from easily traveling through it, and an opposing proximal end 30 of the arm 14 operable with a body of the turnstile 16 such as the pivotal portion 18 for movement of the arm within the passageway 22. For the example herein presented, the turnstile arm 14 has a circular cross-section substantially along its longitudinal axis 32.

Figure 2:
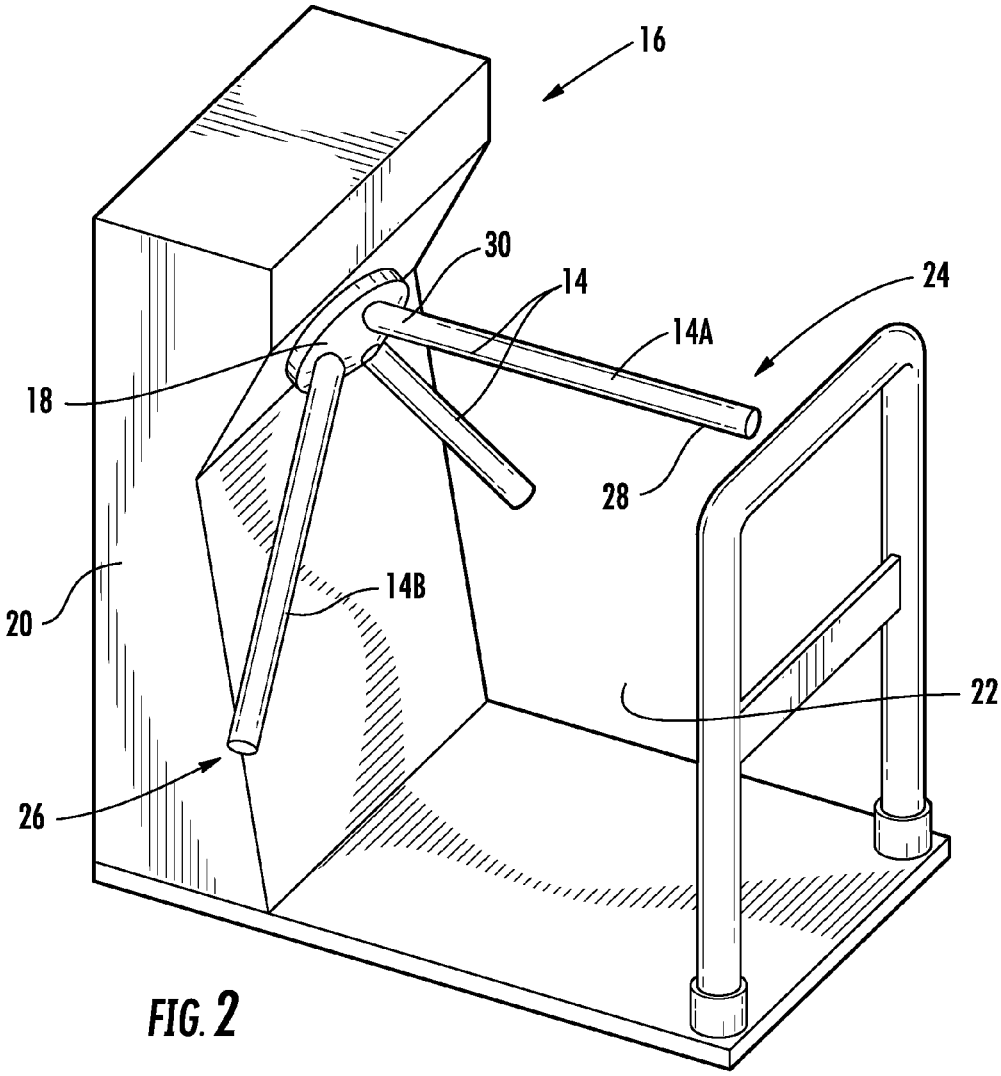
FIG. 2 is a perspective view of one known turnstile herein presented by way of example only.

With continued reference to FIG. 1, the device 10 comprises a first collar 34 carried near the arm distal end 28 and a second collar 36 carried near the arm proximal end 30. One tubular sleeve 38 used with the invention includes opposing first and second ends 40, 42 and a transparent portion 44 therebetween. One embodiment herein described with reference to the drawings includes a fully transparent tubular sleeve. The first and second ends 40, 42 are connected to the first and second collars 34, 36, respectively. For one embodiment of the tubular sleeve 38, an inside surface 44 is generally uniformly spaced from an outside surface 46 of the arm 14 with the outside surface 46 being generally smooth.

Figure 3:
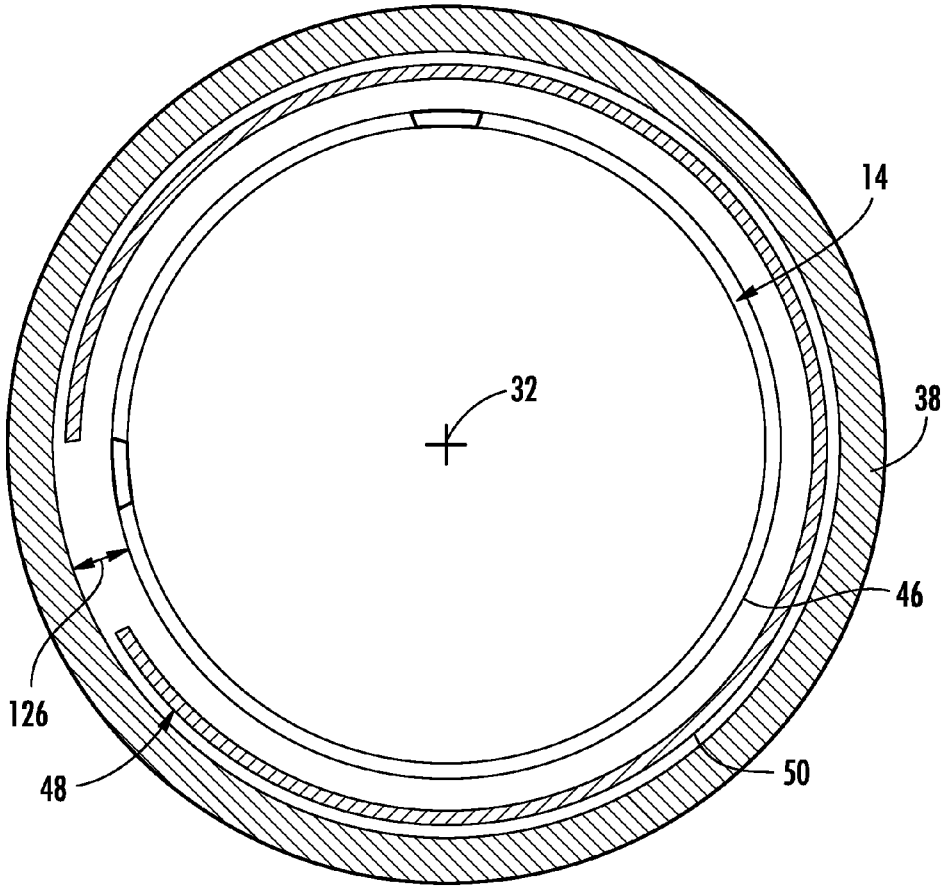
FIG. 3 is a cross sectional view of the embodiment of FIG. 1 taken through lines 3-3.

With reference again to FIG. 1 and now to FIG. 3, a flexible sheet 42 having the indicia 12 carried on its outer surface 50 may be displayed through the transparent tubular sleeve 38. One embodiment as herein described by way of example includes the flexible sheet 48 carried within the tubular sleeve 38 for displaying the indicia 12 for viewing through the transparent sleeve.

As above described with reference to FIG. 1, one embodiment of the device 10 herein described by way of example comprises the first collar 34 carried near the arm distal end 28 and the second collar 36 carried near the arm proximal end 30. It will be understood by those or ordinary skill in the art that the positioning of the collars 34, 36 may be located as desired to accommodate the particular turnstile style. In addition, while the collars 34, 36 herein described below will include distinctive elements, the same collar 34, by way of example may be employed on a single arm 14, as may the collar 36 depending upon the problem to be solved and the particular need being addressed. One combination of the use of the first collar 34 and the second collar 36 is herein described by way of example only for meeting one particular need for displaying the indicia 12.

Figure 4:
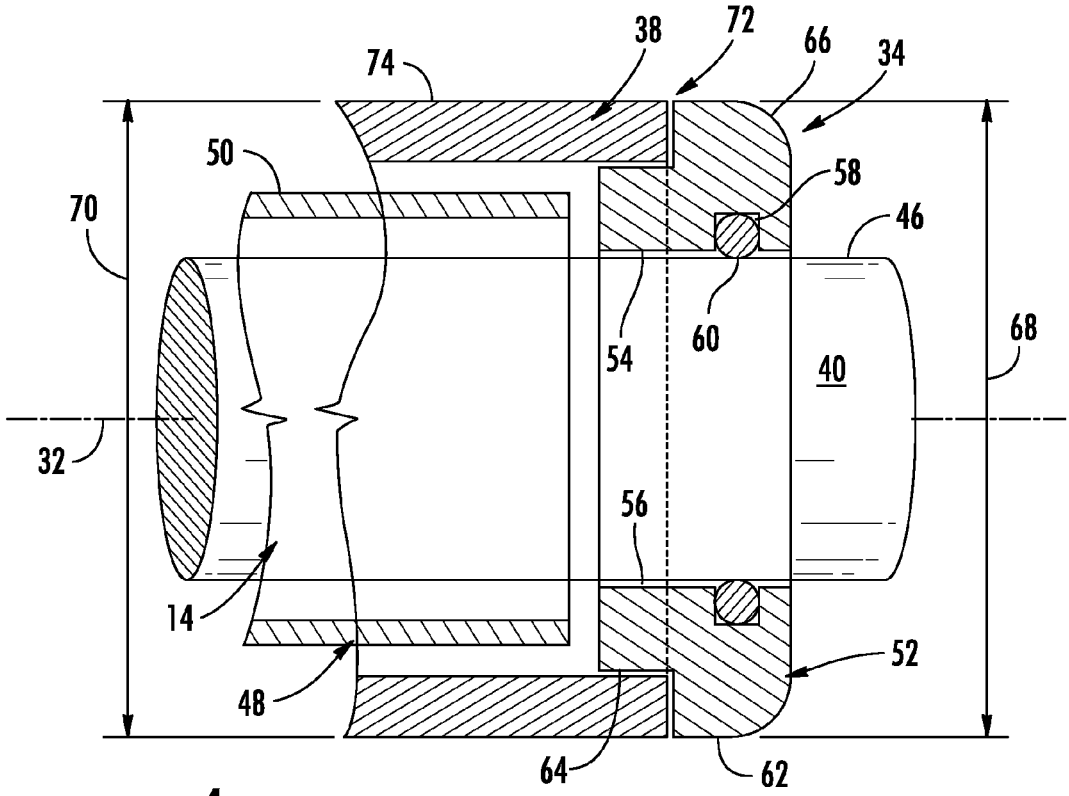
FIG. 4 is a longitudinal cross sectional view of a first collar portion affixed to a distal end of a turnstile arm for embodiment of FIG. 1.

As a result, and with reference to FIG. 4, the first collar 34 is described as comprising a generally cylindrical body 52 having a central opening 54 extending therethrough. The central opening 54 is defined by an inside wall surface 56. A groove 58 is formed within the inside wall surface 56 and extends fully around the cylindrical body 52 within the inside wall surface 56. By way of example, a seal 60, herein provided as an O-ring seal, is carried within the groove 58. The turnstile arm 14 is closely received within the O-ring seal 60 for frictionally securing the first collar 34 to the arm 14.

With continued reference to FIG. 4, the generally cylindrical body 52 is further defined by an outside surface 62. The outside surface 62 comprises a notch 64 extending fully around the outside surface 62. The notch 64 is formed to closely receive the sleeve first end 40 in a manner to frictionally secure the sleeve first end 40 and thus the sleeve 38 to the first collar 34. Alternatively, the connection between the sleeve first end 40 and the first collar 34 may comprise the use of an adhesive or a threaded connection as may be desired to satisfy a particular need and device use. The outside surface 62 further includes a rounded over edge portion 66 opposing the notch 64. The rounded over edge portion 66 extends fully around the cylindrical body 52. The outside diameter 68 of the cylindrical body 52 is similar to an outside diameter 70 of the sleeve 38, thus providing a smooth transition 72 along an overall outside surface of the device 10 from a sleeve outside surface 74 to the first collar outside surface 62.

Figure 5:
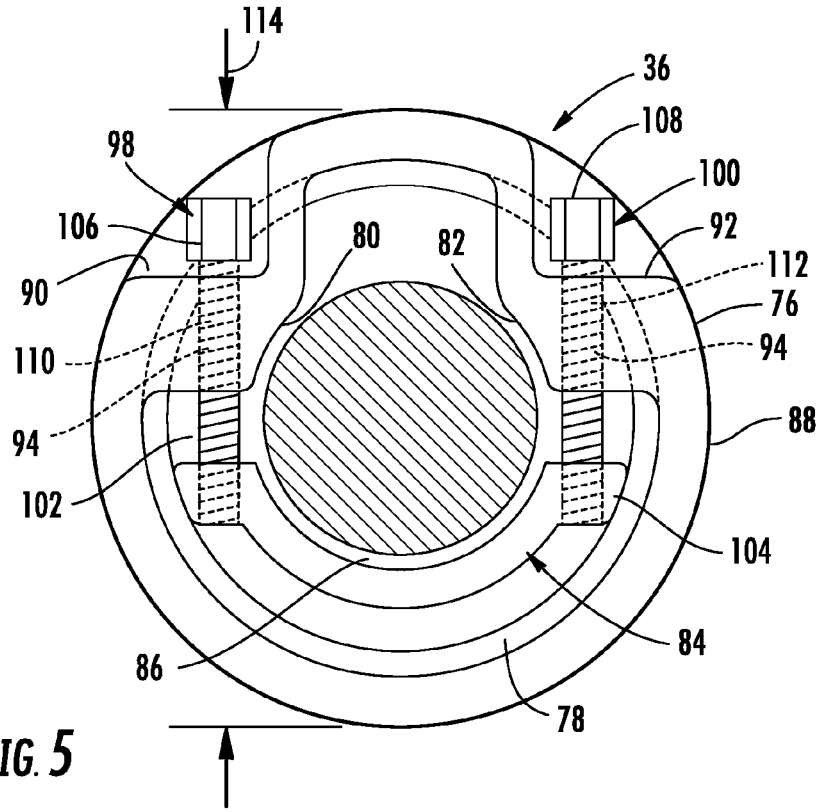
FIG. 5 is a partial end view of a second collar portion affixed to a proximal end of the turnstile arm illustrated for the embodiment of FIG. 1.

With reference now to FIG. 5, the second collar 36 is herein described by way of example as comprising a generally cylindrical body 76 having a central opening 78 extending therethrough. The central opening 78 includes two inside surface portions 80, 82 dimensioned for making frictional contact with the outside surface 46 of the turnstile arm 14. A clamp 84 is carried within the central opening 78. The clamp 84 includes a cradle portion 86 for receiving and making frictional contact with the outside surface 46 of the turnstile arm 14. The cradle portion 86 opposes the two inside surface portions 80, 82 and receives the arm 14 between them, as illustrated with continued reference to FIG. 5. The generally cylindrical body 76 is further defined by an outside surface 88 which comprises two recessed portions 90, 92 each having a bore 94, 96 extending through the generally cylindrical body 76. A fastener, herein described as bolts 98, 100 extends through each bore 94, 96 from each recessed portion 90, 92 to opposing ends 102, 104 of the clamp 84. An adjustment to each bolt 96, 98 releases and tightens a frictional connection of the second collar 36 to the turnstile arm 14. For the example herein described, each bolt includes a head 106, 108 and a threaded shaft 110, 112 threaded into the clamp ends 102, 104. The heads 106, 108 are such to be positioned entirely within the recessed portions 90, 92 and within an outside diameter 114 of the cylindrical body 76.

Figure 6:
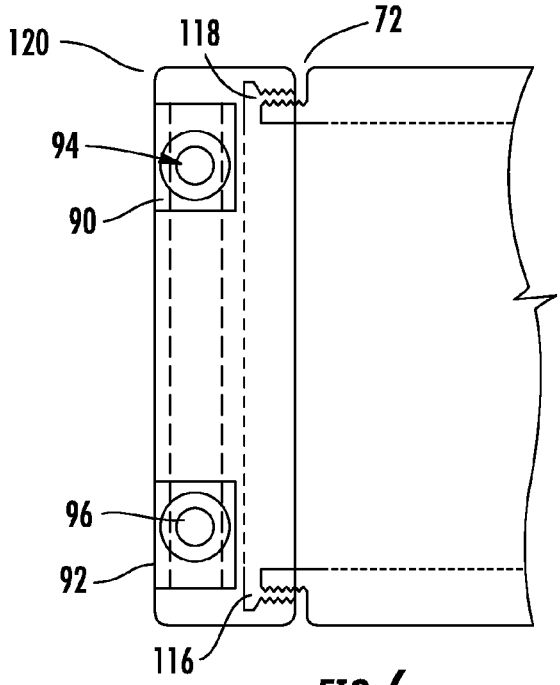
FIG. 6 is a partial top view of one embodiment of the second collar illustrating a threaded connection between the a transparent tubular sleeve and the second collar.

With continued reference to FIG. 5 and to FIG. 6, the central opening 78 may further comprise a notch 116 extending fully around the body 76, wherein the notch 116 closely receives the second end 42 of the sleeve 38 therein for securing the sleeve second end 42 and thus the sleeve 38 to the second collar 36. The securing of the sleeve 38 to the second collar 36 may comprise a threaded connection 118, as illustrated by way of example with reference to FIG. 6, a glued connection or a frictional connection, as desired to meet a particular need.

The outside surface 88 may further include a tapered edge portion 120 extending fully around the cylindrical body 76 with the tapered edge portion 120 opposing the sleeve second end 42 and thus an end of the device. As above described for the first collar 34, the outside diameter 114 of the cylindrical body 76 is similar to the outside diameter 70 of the sleeve 38, thus providing the smooth transition 72 along the outside surface of the device 10 from the sleeve outside surface 74 to the second collar body outside surface 88.

Figure 7:
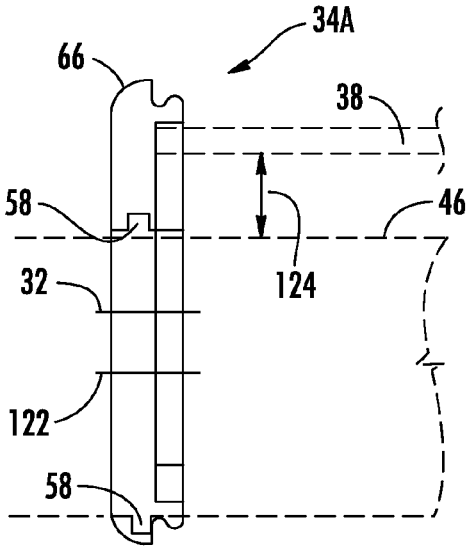
FIGS. 7 and 8 are side and front views, respectively, for one embodiment of a first collar having an offset opening for receiving the turnstile arm therethrough.
Figure 8:
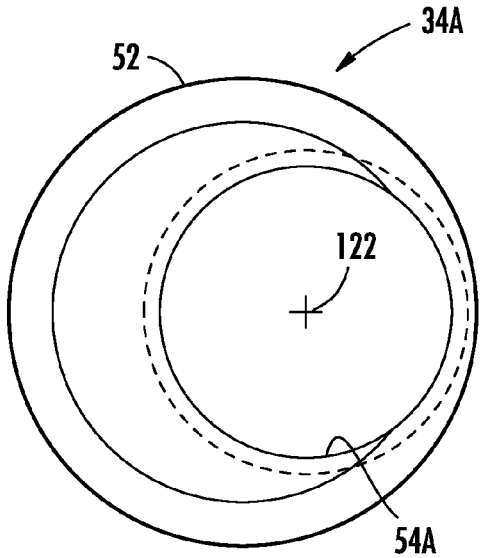

Alternatively, and as illustrated with reference to FIGS. 7 and 8, an alternate embodiment of the first collar 34A, may comprise an off-center central opening 54A, wherein the longitudinal axis 32 of the arm 14 is offset from a center 122 of the opening 54A, thus providing an increased spacing 124 between the arm surface 46 and the tubular sleeve 38. Such increased spacing 124 when compared to a spacing 126 for the embodiment above described with reference to FIG. 3 carrying the sheet 48 therein permits, by way of example, three dimensional advertising and the like in addition to indicia printed on a the sheet.

Figure 9:
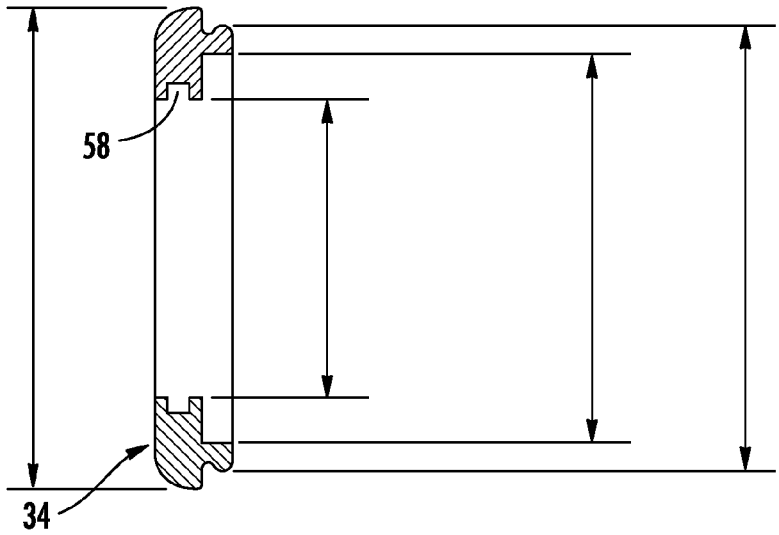
FIG. 9 is a longitudinal cross sectional view of the first collar of FIG. 1 herein illustrating dimensional relationships between collar elements.
Figure 10A:
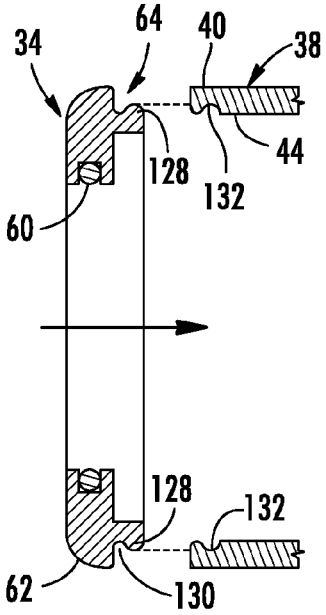
FIGS. 10*a*, 10*b*, and 10 *c* are partial cross sectional views of the collar embodiment of FIG. 9 illustrating a collar in spaced relation to the tubular sleeve, the collar frictionally attached to the tubular sleeve in a snap-fit styled connection, and a the collar partially removed from the sleeve connection, respectively.

Reference is now made to FIG. 9 illustrating an alternate embodiment of the first collar 34. As above described with reference to FIG. 4, the first collar 34 comprises the notch 64 extending fully around the outside surface 62. The notch 64 is formed to closely receive the sleeve first end 40 in a manner to secure the sleeve 38 to the first collar 34. As illustrated with continued reference to FIG. 9 and to FIG. 10*a*, one embodiment of the collar 34 comprises a flange 128 extending around the lower portion 130 of the notch 64. The flange 128 is dimensioned for being received within an inside wall groove 132 of the sleeve 38 proximate the sleeve first end 40 and within an inside surface 44. With such an arrangement, the first collar 34 may be biased against the sleeve first end 40 in such a manner as to cause the flange 128 to be forced into the groove 132 in a frictional snap-fit connection, as illustrated with reference to FIG. 10*b*.

Figure 10B:
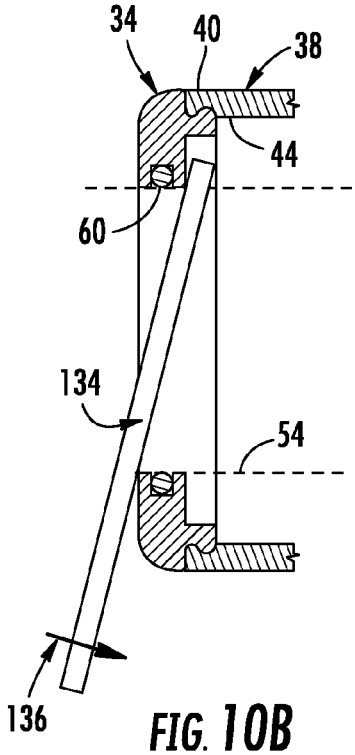
Figure 10C:
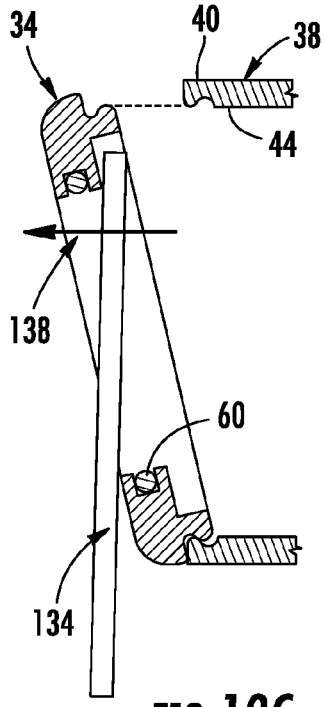

With continued reference to FIG. 10*b*, to remove the collar 34 from its snap-fit connection to the sleeve 38, the collar may simply be pulled away from the sleeve. Alternatively, a pry bar 134 may be placed within the opening 54 in a leveraging manner as herein described by way of example, and the collar 34 hinged away from it snap-fit connection, as illustrated with reference to FIG. 10*c*.

By way of example regarding needs satisfied and problems in the art solved, consider challenges faced and solutions provided by one embodiment of the invention as above described. An initial concern was to securely fasten the device 10 to the turnstile arm 14 without harm to the turnstile arm. This is accomplished by incorporating the clamp 84 into the second (locking) collar 36. The clamp 84 fits the turnstile arm 14 in a half moon fashion reducing risk of damage to the arm. One embodiment of the clamp 84 is made from steel and has a black oxide finish to prevent rust. Turnstile arms vary in diameter and the clamps are made to accommodate the different arm sizes from different manufacturers.

Another challenge faced was to keep the weight of the device 10 to a minimum while having a tamper resistant fastener 98, 100 to tighten the clamp 84. The second locking collar 36 is made from Aluminum and has clear powder coat applied to prevent oxidation. The fasteners 98, 100 include tamper proof machine screws 10-24×1" long. A zinc/nickel plating on the fasteners prevents rust and eliminates galvanizing effects when in contact with the Aluminum second locking collar.

Yet another challenge was to be able to easily install and replace the indicia 1 or artwork carried by the sheet 48. The first (non-locking) collar 34 having the snap-fit feature provides the desired ease in changing the sheet 48. Removing the first collar 34 is expedited by use of the pry bar 134, or the like, described with reference to FIGS. 10*a*-10*c*. One embodiment of the first collar 34 is made from Aluminum and has a clear powder coat applied to prevent oxidation. The rubber O-ring 60 protects the turnstile arm 14 and provides a weather seal for the device 10. The collar 34 is rounded at the outside edges and has the smooth transition to the sleeve for reducing risk of injury to users. On embodiment of the device 10 includes the sleeve 38 made from transparent polycarbonate plastic, practically unbreakable. One embodiment includes the sleeve 38 threaded and glued into the second (locking) collar 36. The glue used is extremely strong and compatible with the Aluminum and plastic materials used. With use of Polycarbonate, a somewhat soft plastic, a hard scratchproof coating is applied to the outside surface of the sleeve 38.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An advertising device comprising: first and second opposing collars each having an opening therethrough dimensioned for closely receiving an arm;

a tubular sleeve having opposing first and second ends and a transparent portion therebetween, the first and second ends connected to the opposing first and second collars, respectively; and indicia displayed from the tubular sleeve;

wherein at least one of the first and second opposing collars comprises:

a generally cylindrical body wherein the opening is defined by an inside wall surface;

a groove within the inside wall surface, the groove extending fully around the cylindrical body a flexible seal carried within the groove, wherein the turnstile arm is received within the flexible seal for frictionally securing the at least one of the first and second collars to the arm;

the generally cylindrical body further defined by an outside surface, wherein the outside surface comprises a flange extending fully around the outside surface, and wherein the flange closely receives the first end of the sleeve therein, and wherein the sleeve includes a groove therein for frictionally securing the flange of the sleeve first end in a snap-fit connection to the cylindrical body; and wherein an outside diameter of the cylindrical body is similar to an outside diameter of the sleeve, thus providing a smooth transition along an outside surface of the device from the sleeve outside surface to the first collar outside surface.

2. The device according to claim 1, wherein the opening is a central opening resulting from a longitudinal axis of the arm being generally aligned with a center of the cylindrical body.

3. The device according to claim 1, wherein the opening is an off-center opening, wherein a longitudinal axis of the arm is offset from a center of the opening, thus providing an increased spacing between the arm surface and a side portion of the tubular sleeve.

4. The device according to claim 1, further comprising a flexible sheet having the indicia carried on a surface thereof, the flexible sheet carried within the tubular sleeve for displaying the indicia through the transparent portion of the tubular sleeve.

5. The device according to claim 1, wherein the outside surface of the cylindrical body includes a rounded over edge portion opposing the groove, the rounded over edge portion extending fully around the cylindrical body.

6. The device according to claim 1, wherein the flexible seal comprises an O-ring.

7. An advertising device comprising:

first and second opposing collars each having an opening therethrough dimensioned for closely receiving an arm;

a tubular sleeve having opposing first and second ends and a transparent portion therebetween, the first and second ends connected to the opposing first and second collars, respectively; and indicia displayed from the tubular sleeve, wherein at least one of the opposing first and second collars comprises:

a generally cylindrical body having the opening extending therethrough being a generally central opening defined by at least two inside surface portions dimensioned for making frictional contact with the turnstile arm;

a clamp carried within the central opening, the clamp having a cradle portion opposing the at least two inside surface portions for making frictional contact with the turnstile arm;

the generally cylindrical body further defined by an outside surface, wherein the outside surface comprises two recessed portions each having a bore extending through the generally cylindrical body;

a fastener having a proximal end carried within each recessed portion and a distal end extending through each bore to opposing ends of the clamp, wherein an adjustment to each fastener releases and tightens a frictional connection of the at least one opposing first and second collars to the turnstile arm, and wherein the proximal end of each fastener is entirely within the recessed portion and within an outside diameter of the cylindrical body;

the inside surface further comprises a notch extending fully around the cylindrical body, wherein the notch closely receives the second end of the sleeve therein for securing the sleeve second end and thus the sleeve to the at least one opposing first and second collars; and wherein an outside diameter defining the cylindrical body is similar to an outside diameter of the sleeve, thus providing a smooth transition along an outside surface of the device from the sleeve outside surface to the at least one opposing first and second collars outside surface.

8. The device according to claim 7, further comprising a flexible sheet having the indicia carried on a surface thereof, the flexible sheet carried within the tubular sleeve for displaying the indicia through the transparent portion of the tubular sleeve.

9. The device according to claim 7, wherein each fastener comprises a bolt having a head and a threaded shaft, the threaded shaft being threaded in to the clamp.

10. The device according to claim 7, wherein the sleeve is secured to the collars by at least one of a threaded connection, a glued connection and a frictional connection.

11. The device according to claim 7, the outside surface further having a tapered edge portion extending fully around the cylindrical body, the tapered edge portion opposing the sleeve.

12. An advertising device useful for displaying advertising indicia from a turnstile arm of a turnstile, wherein the turnstile arm is movable within a passageway between a first position blocking the passageway and a second position allowing a person to move therethrough, the turnstile arm having a distal end extending into the passageway and an opposing proximal end operable with a body of the turnstile for movement of the arm within the passageway, wherein the arm has a circular cross-section substantially along a longitudinal axis thereof, the device comprising:

a first collar carried by the arm distal end thereof and a second collars carried by the arm proximal end thereof; and a tubular sleeve having opposing first and second ends and a transparent portion therebetween, the first and second ends connected to the first and second collar, respectively;

indicia displayed from the tubular sleeve, wherein the first collar comprises:

a generally cylindrical body having an opening extending therethrough defined by an inside wall surface;

a groove within the inside wall surface, the groove extending fully around the cylindrical body an O-ring carried within the groove, wherein the turnstile arm is closely received within the O-ring for frictionally securing the first collar to the arm;

the generally cylindrical body further defined by an outside surface, wherein the outside surface comprises a flange extending fully around the outside surface, wherein the flange closely receives the first end of the sleeve therein, and wherein the sleeve includes a groove therein for frictionally securing the sleeve first end in a snap-fit connection and thus securing the sleeve to the first collar; and an outside diameter of the cylindrical body is similar to an outside diameter of the sleeve, thus providing a smooth transition along an outside surface of the device from the sleeve outside surface to the first collar outside surface;

wherein the second collar comprises:

a second generally cylindrical body having an second opening extending therethrough, the second opening defined by at least two inside surface portions dimensioned for making frictional contact with the turnstile arm;

a clamp carried within the central opening, the clamp having a cradle portion opposing the at least two inside surface portions for making frictional contact with the turnstile arm;

the second generally cylindrical body further defined by an second outside surface, wherein the second outside surface comprises two recessed portions each having a bore extending through the second generally cylindrical body;

a fastener having a proximal end carried within each recessed portion and a distal end extending through each bore to opposing ends of the clamp, wherein an adjustment to each fastener releases and tightens a frictional connection of the second collar to the turnstile arm, and wherein the proximal end of each fastener is entirely within the recessed portion and within an outside diameter of the second cylindrical body; and the inside surface portion further comprises a notch extending fully around the second cylindrical body, wherein the notch closely receives the second end of the sleeve therein for securing the sleeve second end and thus the sleeve to the second collar, wherein an outside diameter defining the second cylindrical body is similar to an outside diameter of the sleeve, thus providing a smooth transition along an outside surface of the device from the sleeve outside surface to the second collar outside surface.

13. The device according to claim 12, further comprising a flexible sheet having the indicia carried on a surface thereof, the flexible sheet carried within the tubular sleeve for displaying the indicia through the transparent portion of the tubular sleeve.

14. The device according to claim 12, therein the opening in the first collar is a central opening resulting from a longitudinal axis of the arm being generally aligned with a center of the cylindrical body of the first collar.

15. The device according to claim 12, wherein the opening in the first collar is an off-center opening, wherein a longitudinal axis of the arm is offset from a center of the opening of the first collar, thus providing an increased spacing between the arm surface and a side portion of the tubular sleeve.

16. The device according to claim 12, wherein an inside surface of the tubular sleeve is generally uniformly spaced from a surface of the arm and an outside surface of the arm is generally smooth.

17. The device according to claim 12, wherein the outside surface of the first collar includes a rounded over edge portion opposing the groove, the rounded over edge portion extending fully around the cylindrical body of the first collar.

18. The device according to claim 7, wherein each fastener comprises a bolt having a head and a threaded shaft, the threaded shaft being threaded in to the clamp.

19. The device according to claim 12, wherein the sleeve is secured to the collar by at least one of a threaded connection, a glued connection and a frictional connection.

20. The device according to claim 12, wherein the outside surface of the second collar further having a tapered edge portion extending fully around the cylindrical body, the tapered edge portion opposing the sleeve.

* * * * *